United States Patent [19]

Petrecca

[11] Patent Number: 4,469,248

[45] Date of Patent: Sep. 4, 1984

[54] RIGHT ANGLE NOZZLE ASSEMBLY

[75] Inventor: Peter J. Petrecca, Atlanta, Ga.

[73] Assignee: Nordson Corporation, Amherst, Ohio

[21] Appl. No.: 407,422

[22] Filed: Aug. 12, 1982

[51] Int. Cl.[3] ..... B67D 5/22

[52] U.S. Cl. ..... 222/48; 222/533; 222/568; 239/288

[58] Field of Search ..... 222/540, 526, 533, 47, 222/48, 566, 568, 23, 41, 146 HE, 148; 239/104, 288, 288.3, 288.5

[56] References Cited

U.S. PATENT DOCUMENTS

| | | | |
|---|---|---|---|
| Re. 24,208 | 9/1956 | Steiner | 222/47 |
| Re. 27,865 | 1/1974 | Baker et al. | 222/504 |
| 3,474,941 | 10/1969 | Sundholm | 222/568 |
| 3,746,570 | 7/1973 | McIntosh | 222/146 HE X |
| 3,952,955 | 4/1976 | Clements | 239/288.5 |

*Primary Examiner*—Joseph J. Rolla
*Assistant Examiner*—George S. Pyryt
*Attorney, Agent, or Firm*—Michael L. Gill; Edmund J. Wasp; Stephen T. Belsheim

[57] ABSTRACT

A right angle nozzle assembly for use with a fluid dispenser. The assembly includes a nozzle body having a nozzle tip disposed at a right angle to the longitudinal axis of the body. The body defines an integral distal projection that projects past the tip so as to protect the tip. The projection includes an alignment slot receivable of a tool so that the direction of the dispensation can be visually perceived as well as selectively set.

6 Claims, 3 Drawing Figures

RIGHT ANGLE NOZZLE ASSEMBLY

BACKGROUND OF THE INVENTION

The invention relates to nozzle assemblies, and in particular to a so-called right angle nozzle assembly for use with a fluid dispenser.

A typical nozzle assembly includes a nozzle tip through which a viscous fluid such as molten hot melt adhesive is dispensed. On occasion a nozzle tip engages another object and is subjected to physical damage. It would be an advantageous feature if a nozzle assembly had a protector that protected the nozzle tip from damaging contact with an external object.

In the application of hot melt adhesives it has always been important that the nozzle be correctly aligned so that the adhesive is dispensed in the desired direction. Sometimes it is only through trial and error that the exact direction of dispensation can be determined. As can be appreciated, the consistent use of a trial and error method can be both time consuming and expensive. Consequently, it would be an advantageous feature of a nozzle assembly to have a visually perceivable indicator that indicates the dispensation direction of the nozzle.

In the course of using a nozzle it may become necessary to change the direction of dispensation. Thus, it would be an advantageous feature of a nozzle assembly to provide structure, such as a slot receivable of a tool, by which the direction of dispensation can be selectively set. It would also be advantageous if the direction of dispensation could be set while the gun module dispenses fluid through the nozzle assembly.

SUMMARY OF THE INVENTION

It is an object of the invention to provide an improved right angle nozzle assembly.

It is another object of the invention to provide an improved right angle nozzle assembly that protects the nozzle tip from contact with external objects.

It is another object of the invention to provide an improved right angle nozzle assembly that includes a visually perceivable indicator indicating the dispensation direction of the nozzle.

It is another object of the invention to provide an improved right angle nozzle assembly that includes structure by which the direction of dispensation can be selectively set.

It is another object of the invention to provide an improved right angle nozzle assembly that allows the direction of dispensation to be changed while the gun module dispenses fluid through the nozzle assembly.

The invention is a nozzle assembly for use with a fluid dispenser. The assembly comprises a nozzle body having a nozzle tip that communicates with the dispenser so that fluid is dispensed through the nozzle tip. The nozzle body defines an integral distal projection adjacent the distal edge thereof. The projection projects past the tip so as to protect the tip from physical contact with external objects.

A connecting means connects the nozzle body to the dispenser and is movable between first and second positions. In the first position the nozzle body is securely attached to the dispenser and in the second position the nozzle body is rotatable relative to the dispenser.

The distal edge of the nozzle body has a slot therein. The slot is aligned with the dispensation direction of the nozzle tip so that the direction of dispensation is visually perceivable. The slot can receive a tool so that when the connecting means is in its second position the nozzle body can be rotated relative to the dispenser so as to dispense fluid through the nozzle tip in a selected direction.

BRIEF DESCRIPTION OF THE DRAWINGS

Further objects and features of the invention will be apparent from the following description of a specific embodiment of the invention in connection with the accompanying drawings. It should be understood that this description is in no way limiting and that various changes may be brought to the disclosed embodiment without departing from the scope of the invention.

DETAILED DESCRIPTION OF A SPECIFIC EMBODIMENT

Figure 1:
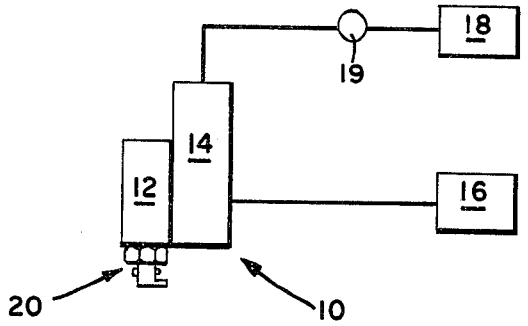
FIG. 1 is a schematic view of a hot melt adhesive dispensing system utilizing the right angle nozzle assembly.

Referring to the drawing, in FIG. 1 there is illustrated a schematic view of a hot melt adhesive dispensing system. The entire system includes a dispenser generally designated as 10 having a gun module 12 mounted to a service block 14. The gun module and service block are described in detail in U.S. Pat. No. Re. 27,865 issued to Baker et al. on Jan. 1, 1974 and assigned to the assignee of this patent application. An adhesive source 16 and an air source 18 are in communication with service block 14 and are described in the previously-mentioned patent. Adhesive source 16 and air source 18 communicate with gun module 12 so as to provide hot melt adhesive which is dispensed from the gun module in a fashion controlled by the solenoid valve 19. A right angle nozzle assembly generally designated as 20 is connected to the gun module 12.

Figure 2:
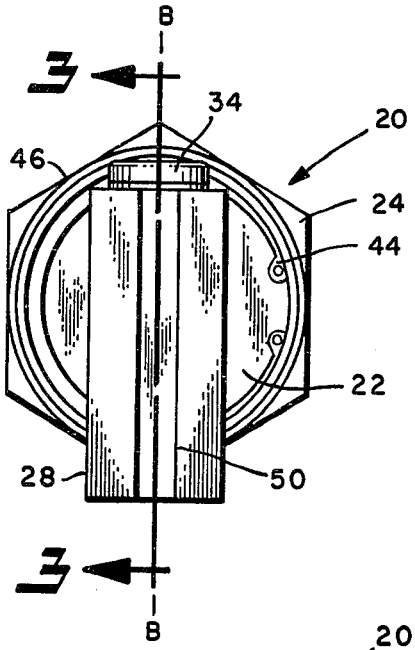
FIG. 2 is a front view of the right angle nozzle assembly of FIG. 1.
Figure 3:
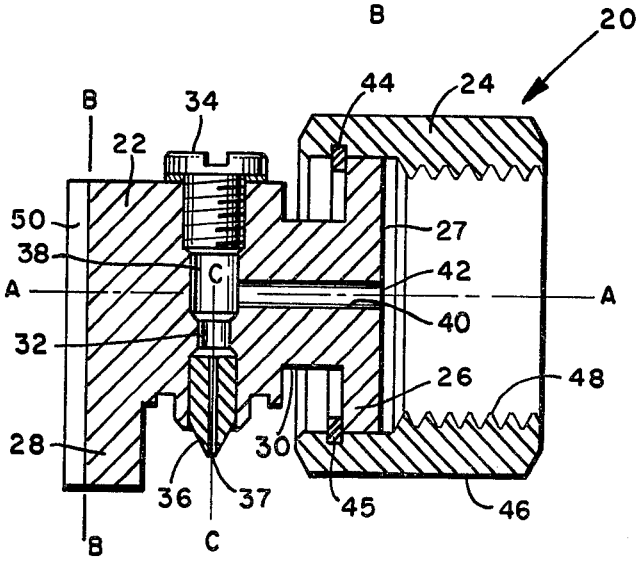
FIG. 3 is a cross-sectional view of the right angle nozzle assembly of FIG. 2 taken along section line 3—3.

Referring more specifically to FIGS. 2 and 3, nozzle assembly 20 includes a nozzle body 22 and nozzle nut 24. Nozzle nut 24 threadedly connects nozzle body 22 to the gun module 12. Nozzle body 22 includes a retaining head 26 at one end thereof, and a projection 28 at the distal end thereof. A reduced diameter portion 30 is adjacent retaining head 26. Retaining head 26 has a sealing surface 27 facing towards the gun module.

Nozzle body 22 contains a transverse fluid passage 32 which is disposed at right angles to a longitudinal axis A—A of nozzle body 22. One end of fluid passage 32 is closed by threaded plug 34 and a nozzle tip 36 is securely inserted in the other end of passage 32. Nozzle tip 36 includes an orifice 37. Plug 34 and nozzle tip 36 define a fluid chamber 38 therebetween. Plug 34 may be removed thereby providing access to fluid chamber 38 to facilitate the cleaning of fluid chamber 38 and fluid passage 32.

Nozzle body 22 further includes a longitudinal fluid passage 40 having an open end 42. The other end of fluid passage 40 terminates within fluid chamber 38.

When nozzle body 22 is connected to nozzle nut 24 a retaining ring 44 is contained within groove 45 so as to maintain a connection between the nozzle body and nozzle nut. Nozzle nut 24 includes external flat surfaces 46 and interior threads 48.

The distal edge of projection 28 has a slot 50 contained therein. The longitudinal axis B—B of slot 50 is generally parallel to the longitudinal axis of C—C of the nozzle orifice 37. Thus, the direction of dispensation of hot melt adhesive through nozzle orifice 37 is visually perceived via slot 50.

Nozzle nut 24 is movable between a first position wherein a nozzle body 22 is securely connected to gun module 12 and a second position in which the nozzle nut is loosened so that nozzle body 22 is rotatable with respect to gun module 12. The degree that nozzle nut 24 can be loosened may vary. By only slighly loosening nozzle nut 24, nozzle body 22 can rotate relative to gun module 12 and still maintain a seal between the interior sealing surface 27 of retaining head 26 and gun module 12. Thus, the direction of dispensation can be selectively set during the operation of the gun module whereby fluid is dispensed through the nozzle assembly without experiencing any leakage of fluid. Slot 50 can receive the end of the tool such as a screw drive so that when nozzle nut 24 is in its second position, nozzle body 22 can be rotated relative to gun module 12 and a dispensation direction selected. Further, a tool such as the screw driver can be received by slot 50 and slot 50 maintained in the selected position while nozzle nut 24 is tightened, or in other words moved from its second to its first position. The ability to maintain the nozzle body steady ensures that the dispensation direction will not be altered by tightening the nozzle nut.

As can be appreciated, molten hot melt adhesive dispensed through gun module 12 passes through longitudinal fluid passage 40 and into fluid chamber 38. The molten adhesive then exits the nozzle assembly 20 through orifice 37 in a direction that is substantially the same as the direction of the longitudinal axis B—B of slot 50.

While I have disclosed a specific embodiment of my invention, persons skilled in the art to which this invention pertains will readily appreciate changes and modifications which may be made in the invention. Therefore, I do not intend to be limited except by the scope of the following appended claims.

What is claimed is:

1. A nozzle for use with a fluid dispenser comprising:

a nozzle body having a nozzle tip, said nozzle tip communicating with the dispenser so that fluid is dispensable through said tip;

said nozzle body defining an integral distal projection adjacent the distal edge thereof, said projection projecting past said tip so as to protect said tip from physical contact with an external object;

said distal edge of said nozzle body having a slot therein, said slot being directionally aligned with said nozzle tip so that the dispensation direction of said nozzle tip can be visually perceived; and means for connecting said nozzle body to the dispenser, said connecting means being movable between a first position in which said nozzle body is securely attached to the dispenser and a second position in which said nozzle body is rotatable relative to the dispenser, and said slot is receivable of a tool for rotating said nozzle body so that when said connecting means is in the second position said nozzle tip can be aligned in a preselected direction.

2. A fluid dispenser for dispensing fluid from a pressurized source of fluid, the dispenser comprising:

a dispenser body having a fluid chamber communicating with the source;

a nozzle mounted to said dispenser body by a connector movable between first and second positions, in the first position said nozzle is securely mounted to the dispenser body, in the second position said nozzle is rotatable with respect to said dispenser body, said nozzle having a nozzle tip through which fluid is dispensed, said tip communicating with said fluid chamber;

a valve means for controlling the flow of fluid through the nozzle tip;

said nozzle including means for protecting the nozzle tip from contact with an external object, said projecting means includes an integral projection defined by said nozzle at the distal edge thereof, said projection projecting past said nozzle tip; and said nozzle including means for visually perceiving the dispensation direction of said nozzle tip, said visually perceiving means comprises a slot defined in said projection, and said slot being directionally aligned with said nozzle tip and receivable of a tool so that said nozzle is rotatable to a selected position by the tool when said connector is in the second position.

3. The nozzle of claim 1 wherein said connecting means includes a nozzle nut rotatably connected to said nozzle body and threadedly connected to said dispenser, said slot receiving the tool so that the tool holds said nozzle body in position while said nozzle nut is threaded relative to said dispenser.

4. The fluid dispenser of claim 2 wherein said slot is receivable of a tool so that the tool holds said nozzle stationary with respect to the dispenser body while said connector is moved between the first and second positions.

5. The nozzle of claim 2 wherein said nozzle body includes a fluid passage communicating with the dispenser and a fluid chamber, said nozzle tip mounted to said body so as to communicate with said chamber, and said chamber communicating with said passage.

6. The nozzle of claim 5 wherein said nozzle tip is disposed generally normal with respect to said passage.

* * * * *